US005747715A

United States Patent [19]

Ohta et al.

[11] Patent Number: 5,747,715

[45] Date of Patent: May 5, 1998

[54] ELECTRONIC MUSICAL APPARATUS USING VOCALIZED SOUNDS TO SING A SONG AUTOMATICALLY

[75] Inventors: Shinichi Ohta; Masashi Hirano, both of Hamamatsu, Japan

[73] Assignee: Yamaha Corporation, Japan

[21] Appl. No.: 691,089

[22] Filed: Aug. 1, 1996

[30] Foreign Application Priority Data

Aug. 4, 1995 [JP] Japan ..... 7-218241

[51] Int. Cl.[6] ..... G10H 1/36; G10H 1/42

[52] U.S. Cl. ..... 84/609; 84/604; 84/622; 84/634; 84/649

[58] Field of Search ..... 84/604–607, 609–610, 84/615–616, 622–625, 649–650, 659–660; 381/51, 52

[56] References Cited

U.S. PATENT DOCUMENTS

| | | | |
|---|---|---|---|
| 3,877,338 | 4/1975 | David | 84/453 |
| 4,527,274 | 7/1985 | Gaynor | 381/51 |
| 4,979,216 | 12/1990 | Malsheen et al. | 381/52 |

FOREIGN PATENT DOCUMENTS

| | | |
|---|---|---|
| 58-37693 | 3/1983 | Japan . |
| 3-200299 | 9/1991 | Japan . |

*Primary Examiner*—William M. Shoop, Jr.
*Assistant Examiner*—Marlon T. Fletcher
*Attorney, Agent, or Firm*—Graham & James LLP

[57] ABSTRACT

An electronic musical apparatus employs a tone-generator section containing a plurality of tone-generator channels, each consisting of a vowel generation unit and a consonant generation unit which operate based on formant sound synthesis, so that a song is automatically swung based on lyric data and performance data. If a syllable within words of a lyric designated by the lyric data consists of a consonant and a vowel, the consonant generation unit generates the consonant with respect to a consonant sounding time which is set in advance whilst the vowel generation unit generates the vowel to follow the consonant. If generation of multiple syllables is allocated to a desired single note within notes corresponding to a melody designated by the performance data, the multiple syllables are sequentially generated during a sounding time of the desired single note. A human operator is capable of inputting words of a lyric to form the lyric data by using a computer keyboard. Or, the human operator is capable of editing the contents of the lyric data by using the computer keyboard. Incidentally, programs and/or the lyric data and performance data can be stored in an internal memory of the electronic musical apparatus; or they can be transferred to the electronic musical apparatus from an external storage device or an external system.

14 Claims, 15 Drawing Sheets

ELECTRONIC MUSICAL APPARATUS USING VOCALIZED SOUNDS TO SING A SONG AUTOMATICALLY

BACKGROUND OF THE INVENTION

1. Field of the Invention

The invention relates to electronic musical apparatuses which use vocalized sounds, simulating human voices, to sing a song automatically. Particularly, the invention relates to an automatic singing-type apparatus which is designed to automatically sing a song using vocalized sounds designated by lyric data which are inputted thereto in text-data form.

2. Prior Art

The electronic musical apparatuses indicate electronic musical instruments, sequencers, automatic performance apparatuses, sound source modules and karaoke systems as well as personal computers, general-use computer systems, game devices and any other information processing apparatuses which are capable of processing music information in accordance with programs, algorithms and the like.

In general, voice synthesis technology is widely used in a variety of fields; and many attempts are made to synthesize voices as natural as possible.

In addition, some proposals are made to provide automatic singing-type apparatuses which are capable of generating voices corresponding to phonemes designated by words of a lyric. One of the automatic singing-type apparatuses is disclosed by the paper of Japanese Patent Laid-Open No. 58-37693, for example. This automatic singing-type apparatus is designed to store lyric data in advance, so that the lyric data are sequentially read out by manipulation of a keyboard and are inputted to a voice synthesis circuit. Thus, the apparatus generates voices corresponding to phonemes designated by the lyric data.

By the way, a singing mode, in which text data are used to sing a song, is different from a normal voice synthesis mode in which text data are used to merely generate voices. For example, if a non-voice interval exists between a syllable and its next syllable which should be sounded in turn, a song using those syllables may sound un-natural on the sense of hearing. In some cases, multiple syllables should be sounded with respect to a single note of a song. So, the singing mode requires plenty of unique conditions which are unique to the singing mode.

However, the apparatuses conventionally known are not designed to pay a sufficient attention to the above conditions unique to the singing mode. So, a song, sung by the conventional apparatuses, sounds like an un-naturally sung song using mechanically generated voices

SUMMARY OF THE INVENTION

It is an object of the invention to provide an electronic musical apparatus which is capable of automatically singing a song in a natural way.

An electronic musical apparatus of the invention employs a tone-generator section containing a plurality of tone-generator channels, each consisting of a vowel generation unit and a consonant generation unit which operate based on formant sound synthesis. The tone-generator section further contains other tone generators for generation of musical tones. Thus, the electronic musical apparatus is capable of automatically singing a song based on lyric data and performance data.

If a syllable within words of a lyric designated by the lyric data consists of a consonant and a vowel, the consonant generation unit contributes to generation of the consonant using a consonant sounding time which is set in advance whilst the vowel generation unit contributes to generation of the vowel to follow the consonant. If generation of multiple syllables is allocated to a desired single note within notes corresponding to a melody designated by the performance data, the multiple syllables are sequentially generated during a sounding time of the desired single note. Thus, the electronic musical apparatus can automatically sing a song in a natural way.

Moreover, a human operator is capable of inputting words of a lyric to form the lyric data by using a computer keyboard. Or, the human operator is capable of editing the contents of the lyric data by using the computer keyboard. Thus, a lyric of the song to be sung can be changed easily.

Incidentally, programs and/or the lyric data and performance data can be stored in an internal memory of the electronic musical apparatus; or they can be transferred to the electronic musical apparatus from an external storage device or an external system.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Figure 1:
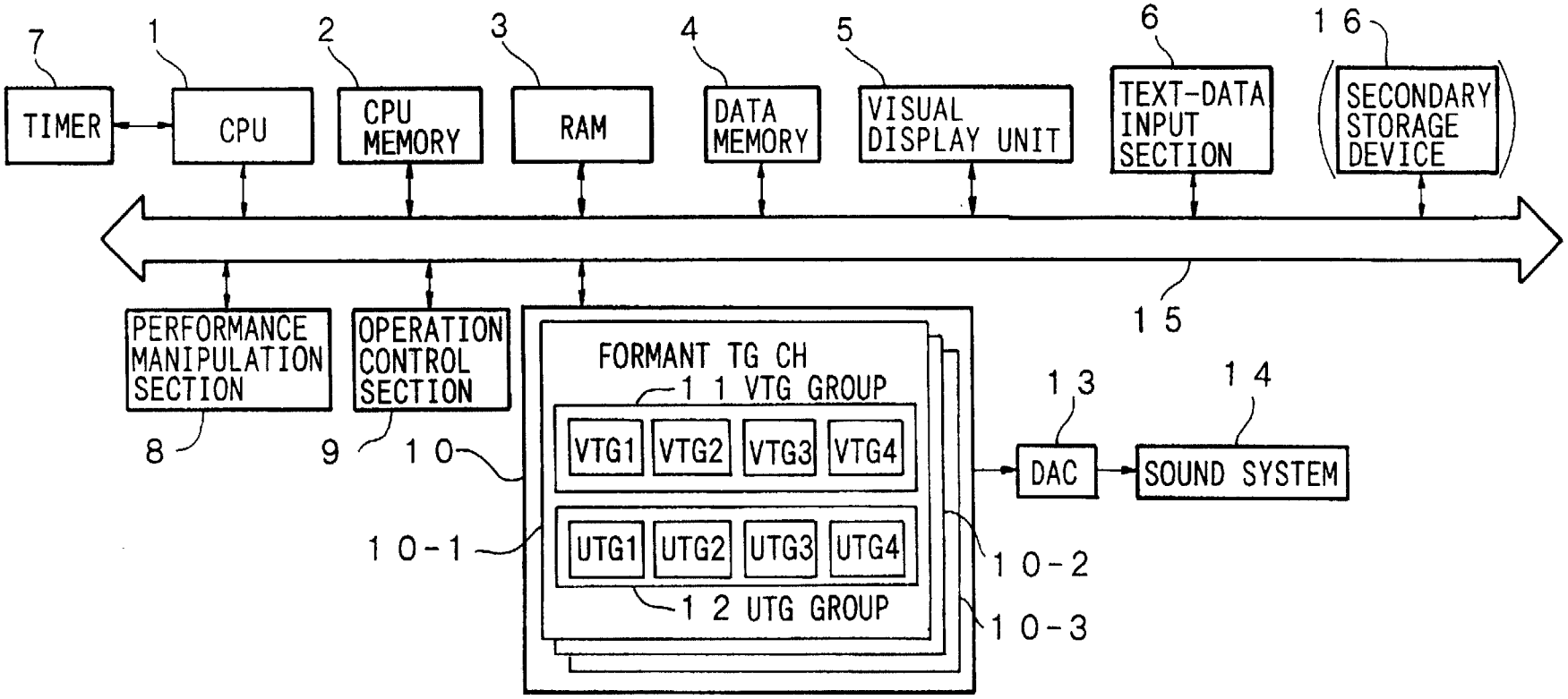
FIG. 1 is a block diagram showing an electronic musical apparatus which is designed in accordance with an embodiment of the invention.

FIG. 1 is a block diagram showing a configuration of an electronic musical apparatus which functions as an automatic singing-type apparatus in accordance with an embodiment of the invention. The electronic musical apparatus of FIG. 1 is configured by a CPU which performs overall control of the apparatus, a CPU memory 2 which stores control programs and a variety of data and a RAM 3 whose storage area is used as a work area or is used for buffers as well as a data memory 4, a visual display unit 5, a text-data input section 6, a timer 7, a performance manipulation section 8 and an operation control section 9. Herein, the data memory 4 stores melody sequence data, lyric sequence data and other data used for voice synthesis; and the visual display unit 5 visually displays states of operation of the apparatus and contents of input data as well as messages for a human operator on a screen thereof. The text-data input section 6 is constructed using a computer keyboard which is manipulated by the human operator to input text data such as lyric data. For example, an ASCII keyboard is used for the text-data input section 6. The performance manipulation section 8 consists of performance-manipulation members manipulated by the human operator (or a performer) such as keys of a keyboard. The operation control section 9 consists of operation-control members such as switches, buttons, nobs and the like.

A tone-generator section 10 contains multiple tone generators which are assigned to three tone-generator channels (FORMANT TG CH) 10-1, 10-2 and 10-3. The present embodiment uses three tone-generator channels. However, it is possible to realize the invention by using at least two tone-generator channels. Incidentally, each tone generator is capable of generating a musical tone. In addition, other tone generators (not shown), which are not assigned to the tone-generator channels, can be used for generation of musical tones.

Further, the electronic musical apparatus of FIG. 1 provides a digital-to-analog converter (abbreviated by 'DAC') 13 and a sound system 14. The DAC 13 converts digital signals, outputted from the tone-generator section 10, to analog signals. The sound system 14 amplifies the analog signals so as to generate sound and/or voice. Moreover, a bus 15 is used for transmission of data among the aforementioned circuit elements of the apparatus.

Incidentally, the CPU memory 2 can be replaced by a ROM which stores programs executed by the CPU 1. Or, it is possible to provide a secondary storage device such as a floppy-disk drive, a hard-disk drive and a CD-ROM drive. So, the programs and data are transferred to the CPU memory 2 which is constructed by a RAM; or they are transferred to the RAM 3. Thus, the programs are executed by the CPU 1. If the electronic musical apparatus is designed to transfer the programs and data to the CPU memory 2 or the RAM 3, step 100 regarding 'initialization' (see FIG. 7) is used to do so. Or, step 102 regarding 'setting process' is used to transfer the programs and data in response to an instruction (or instructions) made by a user. Incidentally, the programs and data can be down-loaded from a network to the electronic musical apparatus of FIG. 1 without providing the secondary storage device 16.

Figure 2:
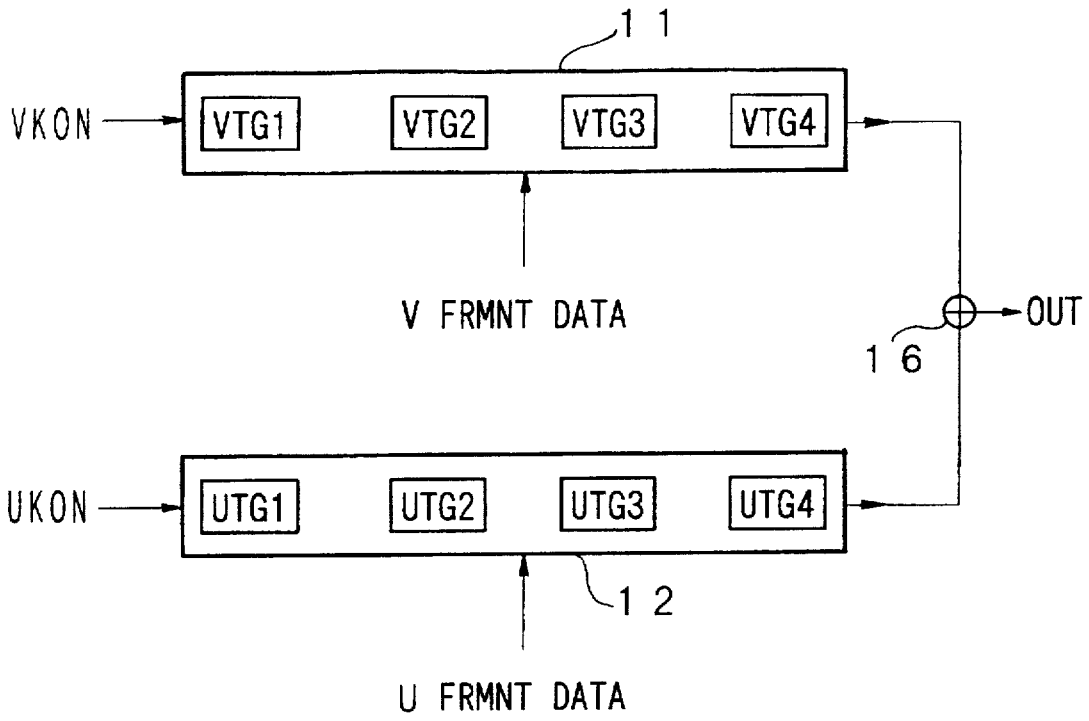
FIG. 2 diagrammatically shows a rough configuration of a tone-generator channel which is provided in a tone generator section shown in FIG. 1.

FIG. 2 shows an internal configuration of the tone-generator channel, i.e., each of the tone-generator channels 10-1 to 10-3 provided in the tone-generator section 10. The tone-generator channel can be configured by any kinds of systems which are capable of performing voice synthesis. In the present embodiment, the tone-generator channel is configured by a VTG group 11 and an UTG group 12 as shown in FIG. 2. The VTG group (e.g., vowel generation unit) 11 consists of four tone generators VTG1 to VTG4 which contribute to generation of a vowel (i.e., voiced sound) whilst the UTG group (e.g., consonant generation unit) 12 consists of four tone generators UTG1 to UTG4 which contribute to generation of a consonant. Such a configuration used for a voice synthesizing apparatus has been already proposed by the present applicant in Japanese Patent Laid-Open No.3-200299. Incidentally, functions of the tone-generator section 10 can be realized by software processing, e.g., tone-generator programs executed by the CPU 1.

The 4 tone generators VTG1 to VTG4 of the VTG group 11 are provided to contribute to regeneration of 4 characteristic portions of a waveform, representing a formant of vowel, respectively. Operation of the tone generators VTG1 to VTG4 is started by a vowel-key-on signal VKON which is outputted from the CPU 1. Each characteristic portion of a formant of vowel is controlled by each tone generator based on vowel formant data (VFRMNT DATA), representing formant center-frequency data, formant level data and formant bandwidth data, which are given from the CPU 1. Outputs of the four tone generators VTG1 to VTG4 are combined together to form a vowel section of a voice (e.g., syllable). By controlling pitch frequency which is applied to the tone generators VTG1 to VTG4, it is possible to control a pitch of a voice to be generated.

On the other hand, the tone generators UTG1 to UTG4 of the UTG group 12 are provided to contribute to regeneration of characteristic portions of a waveform, representing a consonant section of a voice, respectively. Operation of the tone generators UTG1 to UTG4 is started by a consonant-key-on signal UKON which is outputted from the CPU 1. Each tone generator creates a band-pass characteristic or a formant characteristic, regarding each characteristic portion thereof, based on parameters of consonant formant data (UFRNMT DATA) given from the CPU 1, so that such a characteristic is added to white noise to form an output thereof. Then, outputs of the tone generators UTG1 to UTG4 are combined together to form the consonant section of the voice.

The electronic musical apparatus of the present embodiment employs the tone-generator channels, each of which is configured as described above with reference to FIG. 2, so as to produce a voice. At first, the CPU 1 designates a tone-generator channel which should be currently used. Then, the CPU 1 supplies a variety of parameters of consonant formant data (UFRMNT DATA) to the UTG group 12 provided in the designated tone-generator channel; and the CPU 1 supplies a consonant-key-on signal UKON to the UTG group 12 as well. In addition, the CPU supplies a variety of parameters of vowel formant data (VFRMNT DATA) to the VTG group 11. After a lapse of a sounding time of a consonant, the CPU 1 supplies a vowel-key-on signal VKON to the VTG group 11. Thus, the UTG group 12 generates a consonant whilst the VTG group 11 generates a vowel to follow the consonant. An adder 16 adds an output of the UTG group 12 and an output of the VTG group 11 together to form a voice synthesis output (OUT) of the tone-generator channel.

In a sounding time of a voice, there exists a shift phase at which sounding is shifted from a consonant to a vowel or another shift phase at which a pitch of the voice is changed in order to accent the voice. In such a shift phase, it is required that the shifted voice should sound naturally. In order to do so, it is required to continuously vary formants. So, the CPU 1 outputs a set of parameters, representing the formant center-frequency, formant level, formant bandwidth and pitch frequency, by an interval of time, which is about some milli-seconds or so, for example. Or, an envelope generator, which is contained in the tone generator, is used to successively control the parameters.

By the way, 2 syllables can be consecutively sounded by using at least 2 tone-generator channels. In that case, a tone-generator channel, which contributes to generation of a syllable, is subjected to a key-off event whilst another tone-generator channel is used to generate its next syllable. Thus, it is possible to avoid occurrence of noise or occurrence of un-natural sounding at a connection of 2 syllables.

In a singing mode, the electronic musical apparatus normally generate 2 syllables consecutively under a situation where pausing for breath does not occur. In case of the melody sequence data, sounding of a musical tone do not actually continue during an overall note length thereof. In other words, a space time normally exists between notes due to a change in depression of keys. So, when a sounding operation is carried out with respect to the lyric data, notes continuously emerge regardless of a space time between the notes of the melody sequence data; in other words, the notes are sounded like a slur. Thus, it is possible to realize natural generation of voices like voices of a song which is actually sung by a human.

Figure 3:
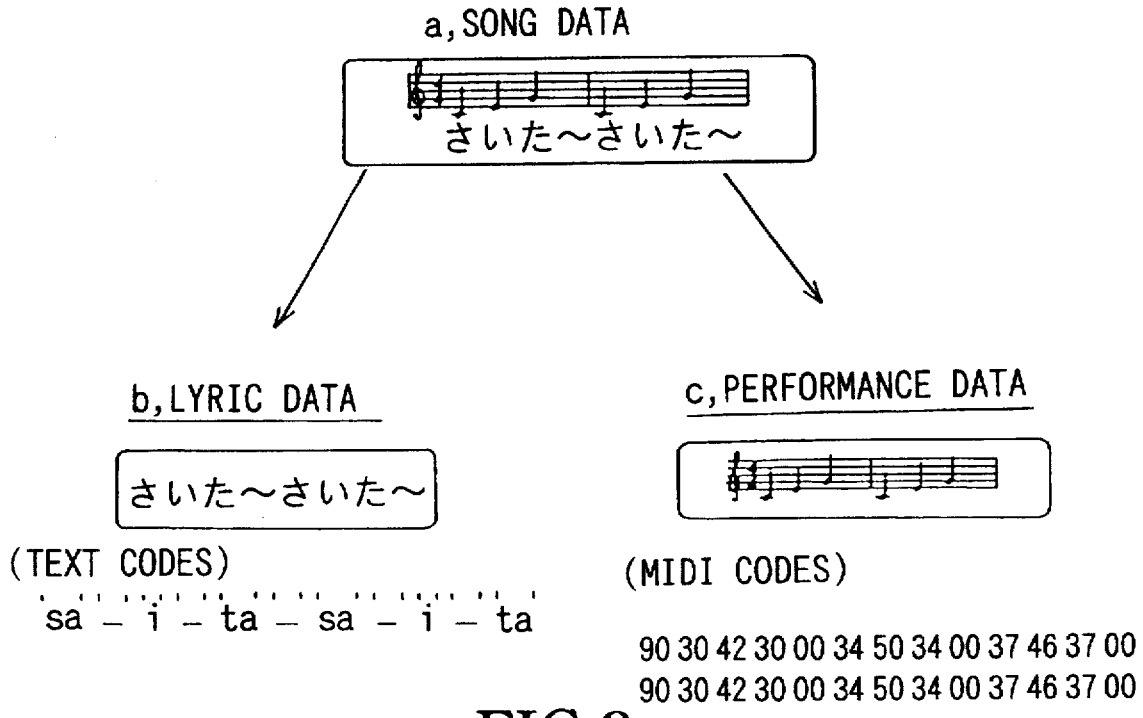
FIG. 3 shows an example of a construction of song data which consists of lyric data and performance data.

Next, contents of data employed by the present embodiment will be described with reference to FIG. 3. Herein, song data 'a' is made by combination of performance data 'c', indicating notes, and lyric data 'b' indicating words of a lyric. FIG. 3 shows an example of the lyric data showing Japanese words of "sa-i-ta", "sa-i-ta" which represent "(flowers are) in bloom" in English. The performance data c is inputted to the electronic musical apparatus, like the known electronic musical instrument, by manipulation of the performance-manipulation members or by entry of data. For example, the performance data c is inputted as the melody sequence data in form of MIDI codes. The performance data c is stored in the date memory 4.

As similar to an input operation to input characters by the known word processor, the lyric data b is inputted to the electronic musical apparatus by manipulating the text-data input section 6. Herein, the lyric data b is inputted in a form of text codes, which are called lyric-text data. Incidentally, entry of Japanese words corresponding to a lyric is made using the Roman alphabet. In order to input the words of a lyric with being related to notes of a melody, a delimiter code, representing a breakpoint between notes, is added to the lyric-text data. As the delimiter code, it is possible to use 'space' (i.e., '_') and the like. For example, if two syllables such as "sa" and "i' are assigned to one quarter note so that the 2 syllables are sounded in a song in accordance with the one quarter note, lyric-text data are inputted as in a form of 'sa''i''_'. Thus, inputted lyric-text data are stored in a lyric-text buffer TXTBUF provided in the RAM 3.

Next, contents of data used by the electronic musical apparatus of the present embodiment will be described.

Figure 4A:
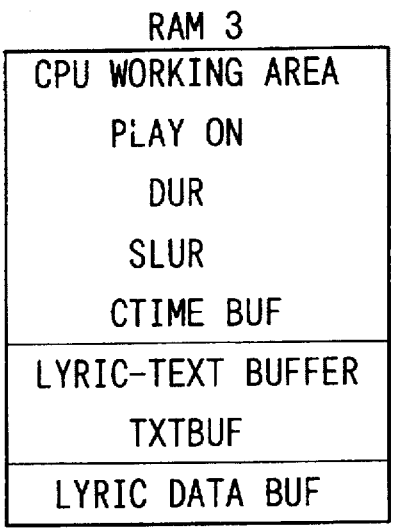
FIG. 4A shows a memory map of a RAM shown in FIG. 1.

FIG. 4A shows a memory map of the RAM three, wherein 3 areas are secured, that is, a CPU working area, a lyric-text buffer 'TXTBUF' and a lyric-sequence-data buffer 'LYRIC DATA BUF'. Herein, the CPU working area is used by the CPU 1; and the lyric-sequence-data buffer is provided to store lyric sequence data which are obtained by performing analysis and conversion on the lyric-text data stored in the lyric-text buffer TXTBUF.

Moreover, several kinds of areas are secured in the CPU working area to provide a flag 'PLAYON', a register 'DUR', a flag 'SLUR' and a buffer 'CTIME BUF'. The flag PLAYON offers an indication as to whether or not the electronic musical apparatus is currently playing a musical performance. The flag is set at '1' in a performance mode whilst the flag is set at '0' in a non-performance mode. The register DUR is an area to store duration data (DURATION) which are contained in melody sequence data. The flag SLUR is set at '1' when multiple syllables are sounded in a sounding time of a single note. The buffer CTIME BUF is an area to store sounding-time data of a consonant.

As described before, the lyric-text buffer TXTBUF is an area to store lyric-text data which are inputted by the text-data input section 6 and are delimited by delimiter codes. The CPU 1 divides the lyric-text data into multiple phoneme data by referring to a phoneme dictionary (not shown). Thus, the lyric-text data are converted to lyric sequence data (LYRIC DATA). The lyric-sequence-data buffer (LYRIC DATA BUF) is an area to store the lyric sequence data. The lyric sequence data (LYRIC DATA) are transferred to the data memory 4.

Incidentally, it is possible to omit provision of the lyric-sequence-data buffer (LYRIC DATA BUF). In that case, the lyric sequence data (LYRIC DATA), which are made by converting the stored content of the lyric-text buffer TXTBUF, are directly written into a specific area within the data memory 4.

Next, details of data stored in the data memory 4 will be described with reference to FIGS. 4B, 5, 6A and 6B.

Figure 4B:
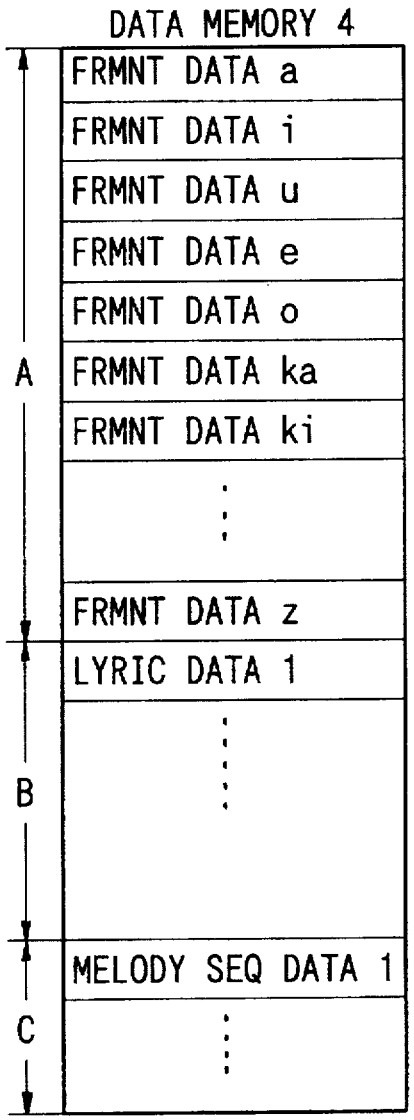
FIG. 4B shows a memory map of a data memory shown in FIG. 1.

FIG. 4B shows a memory map of the data memory 4. An overall storage area of the data memory 4 is divided into 3 storage areas A, B and C. Herein, a formant-data storage area A stores a plenty of formant data each corresponding to each syllable in the Japanese syllabary. A lyric-sequence-data storage area B stores a plurality of lyric sequence data (LYRIC DATA) each corresponding to a lyric of a tune to be played. A melody-sequence-data storage area C stores a plurality of melody sequence data (MELODY SEQ DATA) each corresponding to a melody of a tune to be played.

Figure 5:
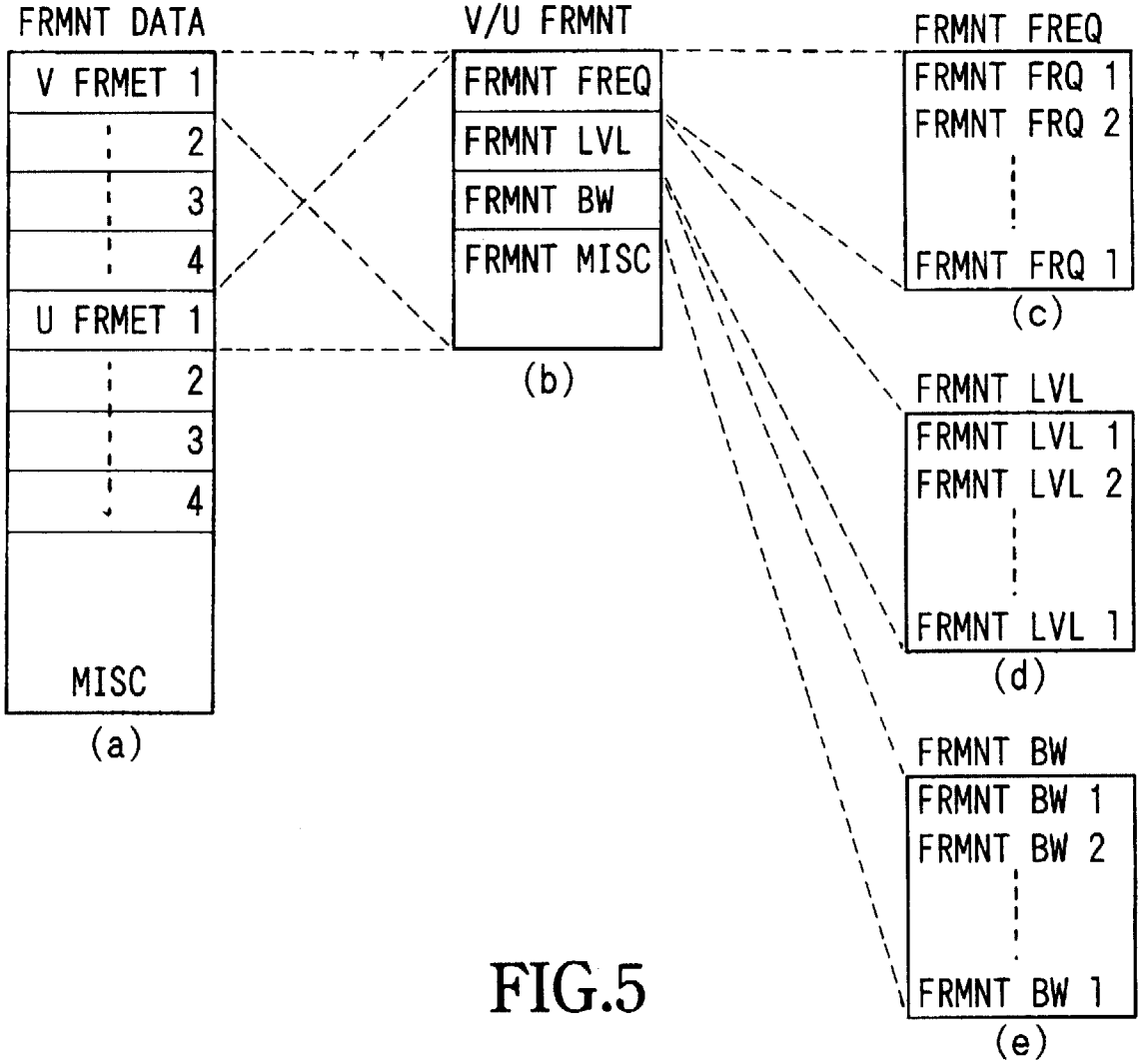
FIG. 5 shows an example of a construction of formant data.
Figure 6A:
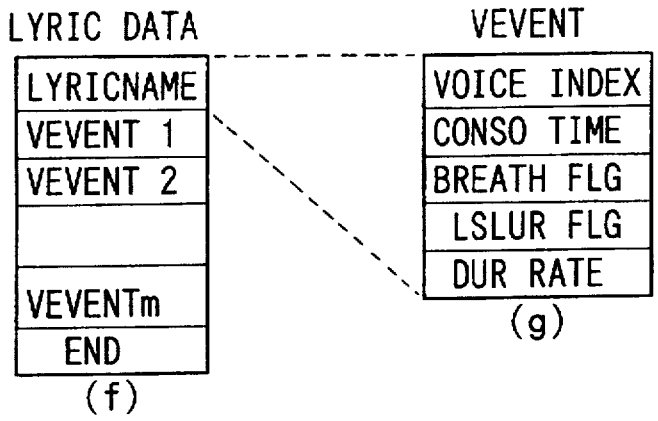
FIG. 6A shows an example of a construction of lyric sequence data.
Figure 6B:
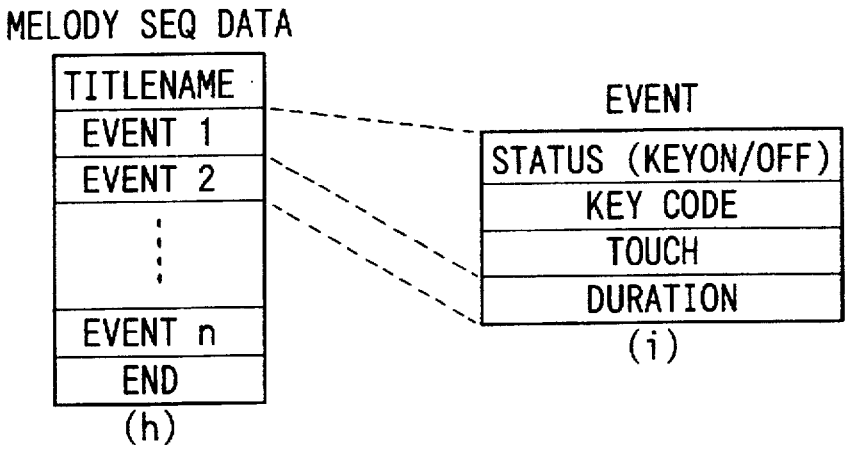
FIG. 6B shows an example of a construction of melody sequence data.

Specifically, the formant-data storage area A stores formant data 'FRMNT DATAa' to formant data 'FRMNT DATAz', each of which correspond to each syllable. Each formant data (FRMNT DATA) has a data format (a) which is shown in FIG. 5. That is, the formant data consist of four vowel formant data 'VFRMNT1' to 'VFRMNT4', which are supplied to the four tone generators VTG1 to VTG4 of the VTG group 11 respectively, four consonant formant data 'UFRMNT1' to 'UFRMNT4', which are supplied to the four tone generators UTG1 to UTG4 of the UTG group 12 respectively, and complementary data 'MISC'. Herein, the complementary data MISC contain volume correction data by which volume correction is made such that sounding is performed in a uniform tone volume. As for a vowel syllable which consists of a vowel only, vacant data are stored as the consonant formant data.

Each of the vowel formant data and consonant formant data has a data format (b) shown in FIG. 5. Specifically, each of them consists of formant center-frequency data (FRMNT FREQ), formant-level data (FRMNT LVL), formant bandwidth data (FRMNT BW) and formant complementary data (FRMNT MISC).

The formant center-frequency data (FRMNT FREQ) have a data format (c) which stores a set of time-series data of 'FRMNT FRQ1', 'FRMNT FRQ2', . . . . 'FRMNT FRQ1'. The time-series data are sequentially read out by frame timings and are applied to the corresponding tone generators of the VTG group 11 of the UTG group 12.

Similarly, the formant-level data (FRMNT LVL) have a data formant (d) which stores a set of time-series data of 'FRMNT LVL1', 'FRMNT LVL2', . . . . 'FRMNT LVL1' whilst the formant bandwidth data (FRMNT BW) have a data format (e) which stores a set of time-series data of 'FRMNT BW1', 'FRMNT BW2', . . . . 'FRMNT BW1'. Thus, those time-series data are sequentially read out and are applied to the corresponding tone generators of the VTG group 11 or the UTG group 12.

The above construction of the formant data enables regeneration of 'time-varying' formant data well.

Incidentally, the aforementioned time-series data can be stored in a rough manner with respect to time. In that case, interpolation calculations are employed to calculate parameters which are not actually stored. If same data repeatedly appear in the time-series data, it is possible to omit storage of the same data to be repeated. Thus, it is possible to compress storage capacity which is required to store the formant data.

As the formant complementary data (FRMNT MISC), it is possible to store data for imparting effects, such as vibrato or fluctuation, to performance played by the electronic musical apparatus.

The lyric-sequence-data storage area B stores the aforementioned lyric sequence data (LYRIC DATA) which are transferred thereto from the-lyric-sequence-data buffer (LYRIC DATA BUF) of the RAM 3. The lyric sequence data (LYRIC DATA) have a data format (f), shown in FIG. 6A, which consists of a name of a lyric (LYRICNAME), a plurality of voice event data 'VEVENT1' to 'VEVENTm' corresponding to syllables contained in the lyric, and an end code (END) representing an end of the lyric sequence data.

Each voice event data (VEVENT) have a data format (g) which consists of syllable designating data (VOICE INDEX) for designating a syllable to be sounded, consonant-sounding-time data (CONSO TIME), a breath designating flag (BREATH FLG), a continuous-sounding designating flag (LSLUR FLG) and sounding-sustain-rate data (DUR RATE). Herein, the consonant-sounding-time data represent a sounding time of a consonant when the electronic musical apparatus generates a syllable containing the consonant. The breath designating flag designates a decision as to whether or not pausing for breath should be made after generation of the syllable. The continuous-sounding designating flag designates a decision as to whether or not two syllables should be continuously generated in a duration of one note, in other words, two syllables should be continuously generated in accordance with a same key-on event. If continuous generation of two syllables is designated by a same key-on event, the sounding-sustain-rate data represent a rate of a sounding time of a first syllable, within the two syllables, in a sustaining time (i.e., 'DURATION TIME') of the key-on event. That is, a sounding time 'd' of the first syllable is calculated by an equation as follows:

$$d=(\text{DURATION})\times(\text{DUR TIME})$$

So, generation of a next syllable is started after a lapse of the sounding time d.

The melody-sequence-data storage area C stores the melody sequence data with respect to each tune. Each melody sequence data (MELODY SEQ DATA) have a data format (h), shown in FIG. 6B, which consists of a title of a tune (TITLENAME), a plurality of event data 'EVENT1' to 'EVENTn', and an end code (END) representing an end of the melody sequence data. Each event data (EVENT) are configured like normal automatic performance data. Specifically, two event data (EVENT) have a data format (i) which consists of key-event data and duration data. Herein, the key-event data consist of a status byte (STATUS (KEYON/OFF)) representing an instruction code corresponding to either a key-on event or a key-off event, keycode information (KEYCODE) and touch information (TOUCH) whilst the duration data (DURATION) represent time information corresponding to a duration between events. In other words, the key-event data and the duration data are alternatively stored as the event data. Incidentally, if event data, corresponding to a key-on event in which touch information is zero (i.e., TOUCH=0), is treated as event data regarding a key-off event.

As described above, the melody sequence data (MELODY SEQ DATA) and the lyric sequence data (LYRIC DATA) are independently stored in the data memory 4. Thus, it is possible to additionally store lyric sequence data in response to melody sequence data which have been already stored in the data memory 4. So, the melody sequence data, which have been previously stored, can be used in an effective way.

By the way, it is not required that one lyric sequence data are stored with respect to one melody sequence data. So, it is possible to store multiple lyric sequence data with respect to one melody sequence data. Or, it is possible to store multiple melody sequence data with respect to one lyric data. Thus, it is possible to sing a song with a same melody but by using different lyrics.

Next, details of the operation of the electronic musical apparatus will be described with reference to FIGS. 7 to 12.

Figure 7:
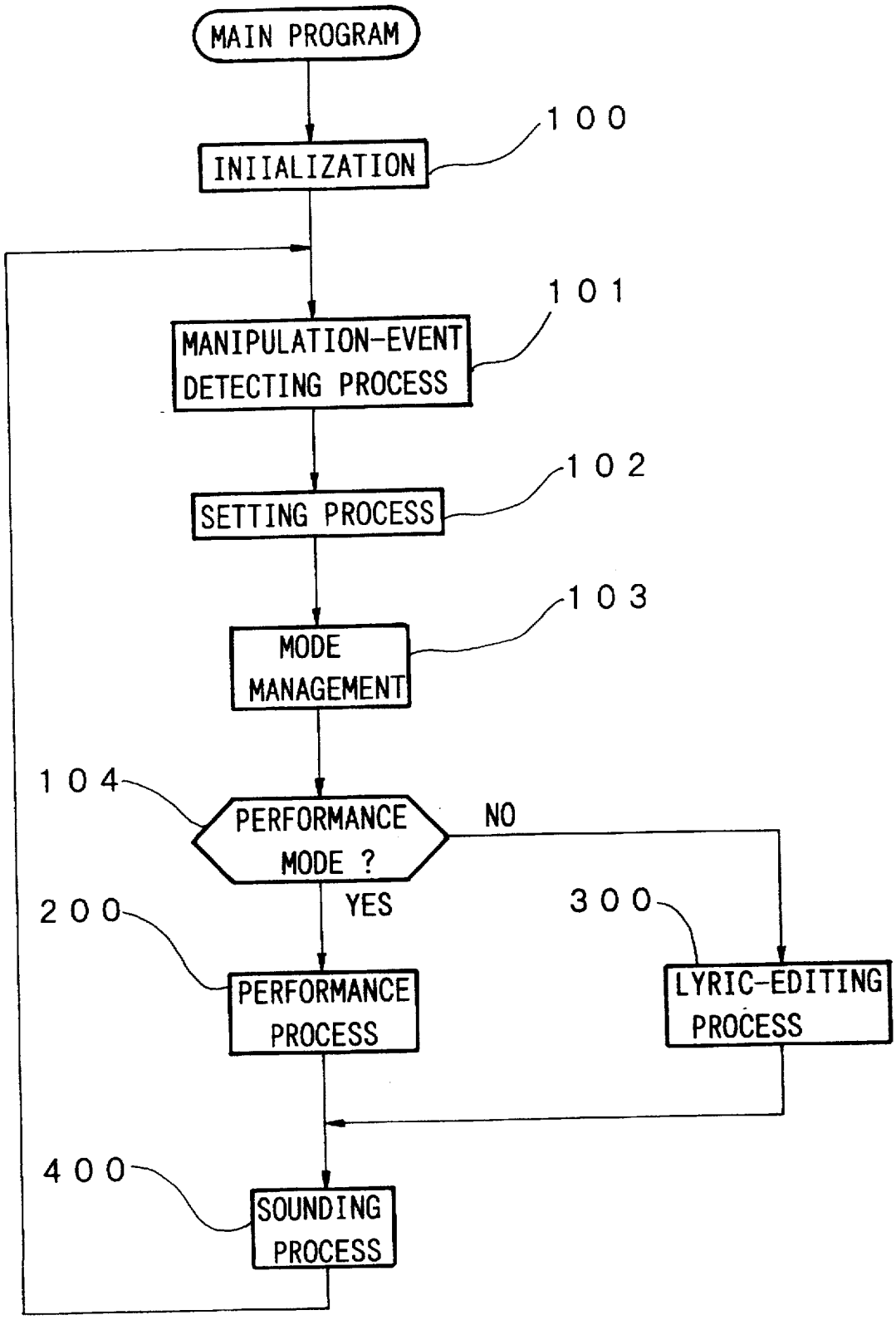
FIG. 7 is a flowchart showing a main program executed by a CPU shown in FIG. 1.

FIG. 7 is a flowchart showing a main program which is executed by the CPU 1. In order to avoid complexity of description, the present specification describes about software processes regarding two modes only (i.e., performance mode and lyric-editing mode) which directly relate to the invention. Actually, however, there are provided other processes such as an input process to input melody sequence data and an editing process. Therefore, a rectangular block, corresponding to a step representing the other processes, can be inserted between a step 400 and a step 101 in FIG. 7.

When the operation of the electronic musical apparatus is started, the apparatus firstly proceeds to step 100 in which initialization is performed. In next step 101, a manipulation-event detecting process is performed so that detection is made as to whether or not a manipulation event occurs in each of the text-data input section 6, the performance manipulation section 8 and the operation control section 9. In step 102, the apparatus sets a variety of parameters so as to designate a tune to be played in response to the manipulation event which is detected by the manipulation-event detecting process of step 101. If the manipulation event relates to manipulation regarding a certain mode, the apparatus proceeds to step 103 in which mode management is performed with respect to the performance mode and lyric-editing mode.

In step 104, a decision is made as to whether or not an operation mode currently designated indicates the performance mode. In case of the performance mode, the apparatus proceeds to step 200. If the operation mode is not the performance mode, in other words, if the operation mode is the lyric-editing mode, the apparatus proceeds to step 300. So, the apparatus executes either a performance process of step 200 or a lyric-editing process of step 300. Then, the apparatus proceeds to step 400 in which a sounding process is executed. Thereafter, the aforementioned processes are repeated.

Next, details of the performance process (see step 200 in FIG. 7) will be described with reference to flowcharts of FIGS. 8A, 8B, 9A, 9B, 10A, 10B and 10C. When processing of the apparatus enters into the performance process of step 200, program control goes to step 201 in FIG. 8A. In step 201, a decision is made as to whether or not the apparatus is currently playing musical performance. This decision is made by referring to the flag PLAYON which is set in the RAM 3. If PLAYON=0, in other words, if the apparatus is set in a non-performance mode, the apparatus proceeds to step 202 in which a decision is made as to whether or not the manipulation event, which is detected by the aforementioned manipulation-event detecting process of step 202 (see FIG. 7), indicates a song-start event. If result of the decision is 'NO', execution of the performance process is terminated.

By the way, if result of the decision made by the aforementioned step 201 is 'NO', in other words, if it is detected that the apparatus is currently playing musical performance, the apparatus proceeds to step 242 in which a decision is made as to whether or not the manipulation event, detected by the manipulation-event detecting process of step 101, indicates a performance-stop event. If result of the decision is 'YES', the apparatus proceeds to step 243 in which the flag PLAYON is reset to '0' so that a performance termination process is executed. Thus, execution of the performance process is terminated. On the other hand, if result of the decision made by the step 242 is 'NO', the apparatus proceeds to step 204, content of which will be described later.

Meanwhile, if result of the decision made by the step 202 is 'YES', in other words, if the manipulation event indicates the song-start event, the apparatus proceeds to step 203 in which the duration timer (DURATION) is reset. Herein, the duration timer is provided to measure an interval of time between notes, i.e., a duration time. In addition, '1' is set to both of a voice-event pointer 'm' and a melody-event pointer 'n'. Further, the flag PLAYON set in the RAM is set at '1'. The voice-event pointer m designates a readout position of voice event data (VEVENT) provided in the lyric sequence data (LYRIC DATA) which are stored in the lyric-sequence-data storage area B of the data memory 4. The melody-event pointer n designates a readout position of event data (EVENT) provided in the melody sequence data (MELODY SEQ DATA) which are stored in the melody-sequence-data storage area C of the data memory 4.

Next, step 204 is executed after completion of the step 203. Or, the step 204 is executed if the manipulation event indicates an event other than the performance-stop event in the performance mode, in other words, if result of the decision of the step 201 is 'NO' and result of the decision of the step 242 is 'NO'. In step 204, a decision is made as to whether or not the duration timer completes a counting operation on duration data. If result of the decision is 'NO', execution of the performance process is terminated.

On the other hand, if the duration timer has been reset or if the duration timer completes the counting operation, result of the decision of the step 204 turns to 'YES'. Thus, the apparatus proceeds to step 205.

In step 205, a decision is made as to whether or not the flag SLUR is set at '0'. As described before, the flag SLUR is set at '1' when generation of multiple syllables is assigned to a same key-on event. So, if result of the decision of the step 205 is 'YES', it is indicated that no syllable remains to be sounded in a period of time corresponding to a same key-on event. If result of the decision is 'NO', it is indicated that another syllable remains to be sounded in a period of time corresponding to a same key-on event. If result of the decision is 'NO', program control directly goes to step 210 without executing steps 206 to 209 (see FIG. 8B). On the other hand, if result of the decision is 'YES', the apparatus proceeds to step 206.

In step 206, the apparatus performs a reading operation on the data memory 4 to read out event data EVENTn from the melody sequence data (MELODY SEQ DATA). The reading operation is started from the readout position of the melody-sequence-data storage area C which is designated by the melody-event pointer n. As described before, data read out from the melody sequence data may be key-event data, duration data or an end code. In step 207, a decision is made as to whether or not the read event data EVENTn correspond to key-event data. If result of the decision is 'YES', the apparatus proceeds to step 208 in which a decision is made as to whether or not the operation mode currently designated indicates a singing mode. If result of the decision of the step 208 is 'YES', the apparatus proceeds to step 209 in which a decision is made as to whether or not the key-event data correspond to a key-on event.

If result of the decision of the step 209 is 'YES', the apparatus proceeds to step 210 in which the apparatus performs a reading operation on the data memory 4 to read out voice event data VEVENTm from the lyric sequence data (LYRIC DATA), wherein the reading operation is started from the readout position of the lyric-sequence-data storage area B which is designated by the voice-event pointer m. Next, the apparatus proceeds to step 211 in FIG. 9A in which a decision is made as to whether or not a flag LSLUR provided in the read voice event data VEVENTm is set at '0'.

If result of the decision of the step 211 is 'YES', the apparatus proceeds to step 212 in which the apparatus checks a sounding state of a previous voice, in other words, the apparatus determines whether to currently produce sounds of the lyric. In next step 213, a decision is made as to whether or not a tone-generator channel corresponding to the previous voice is currently conducting a sounding operation. If the previous voice is currently sounding, the apparatus proceeds to step 214 in which the apparatus issues an key-off instruction with respect to the tone-generator channel which is currently conducting the sounding operation with respect to the previous voice. Then, the apparatus proceeds to step 215. In contrast, if the step 213 determines that no voice is currently sounding, program control directly goes to step 215. In step 215, the apparatus searches a vacant tone-generator channel within the tone generator section 10. Thus, a sounding operation for a syllable corresponding to a current voice event is assigned to the vacant tone-generator channel.

After completion of the step 215, the apparatus proceeds to step 216 to perform operations as follows:

The apparatus issues a key-on signal based on formant data which are designated by syllable designating data 'VOICE INDEXm' provided in the voice event data VEVENTm, so that the key-on signal is supplied to the tone-generator channel which is searched out by the step 215. At the same time, consonant-sounding-time data 'CONSO TIMEm', contained in the voice event data VEVENTm, are written into the buffer 'CTIME BUF' provided in the RAM 3.

The steps 212 to 216 are provided to achieve a key-off instruction with respect to the previous syllable at a stage where a new syllable is to be sounded.

In step 217, the melody-event pointer n is renewed using an increment of '1'. In next step 218, the apparatus refers to the flag SLUR set in the RAM 3 so as to make a decision as to whether or not the flag SLUR is set at '0'. If result of the decision is 'YES', execution of the performance process is ended. On the other hand, if the flag SLUR is set at '1', program control goes to step 219 in FIG. 10C. In step 219, a value stored in the register DUR of the RAM 3 is multiplied by a value of sounding-sustain-rate data 'DUR RATEm' provided in the voice event data VEVENTm, so that result of multiplication is used as a set duration value to start a counting operation of the duration timer. In step 220, the flag SLUR in the RAM 3 is reset to '0'. Then, execution of the performance process is ended.

Figure 10A:
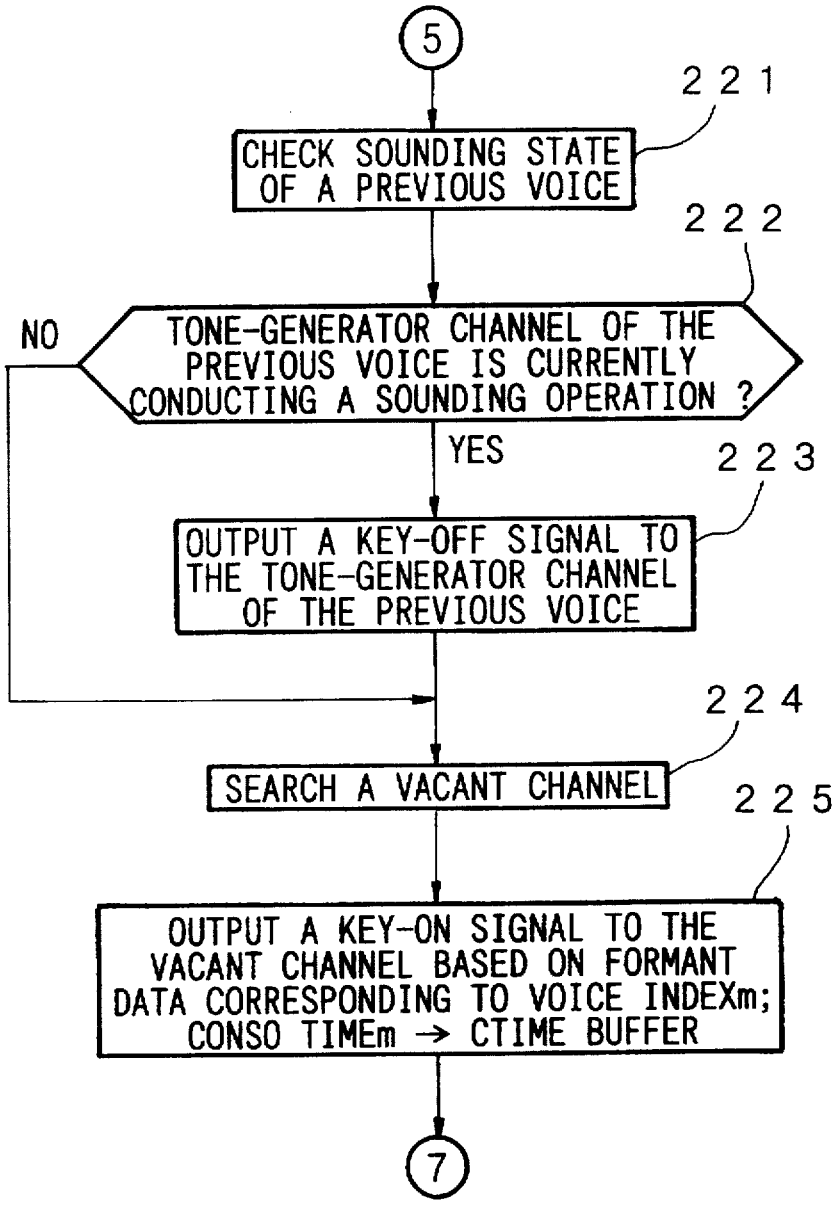
FIGS. 10A, 10B and 10C are flowcharts showing still another parts of the performance process.

By the way, if result of the decision made by the aforementioned step 211 is 'NO', in other words, if the flag LSLUR within the voice event data VEVENTm is set at '1' so that a syllable is followed by another syllable which should be sounded in a period of time corresponding to a same key-on event, the apparatus proceeds to step 221 in FIG. 10A. In step 221, the apparatus checks a sounding state of a previous voice. In step 222, a decision is made as to whether or not a tone-generator channel corresponding to the previous voice is currently conducting a sounding operation. If the tone-generator channel is currently conducting the sounding operation, the apparatus proceeds to step 223 so as to output a key-off signal to the tone-generator channel. Then, the apparatus proceeds to step 224. On the other hand, if the step 222 determines that the tone-generator channel is not currently conducting the sounding operation, program control directly goes to step 224.

In step 224, the apparatus searches a vacant channel within the tone generator section 10. Thus, a sounding operation for a syllable corresponding to a current voice event is assigned to the tone-generator channel which is searched out by the step 224. Then, the apparatus proceeds to step 225 so as to perform operations as follows:

The apparatus issues a key-on signal based on formant data which are designated by syllable designating data 'VOICE INDEXm' provided in the voice event data VEVENTm, so that the key-on signal is supplied to the tone-generator channel which is searched out by the step 224. At the same time, consonant-sounding-time data 'CONSO TIMEm', contained in the voice event data VEVENTm, are written into the buffer 'CTIME BUF' in the RAM 3.

Incidentally, the above steps 221 to 225 are similar to the aforementioned steps 212 to 216.

Figure 10B:
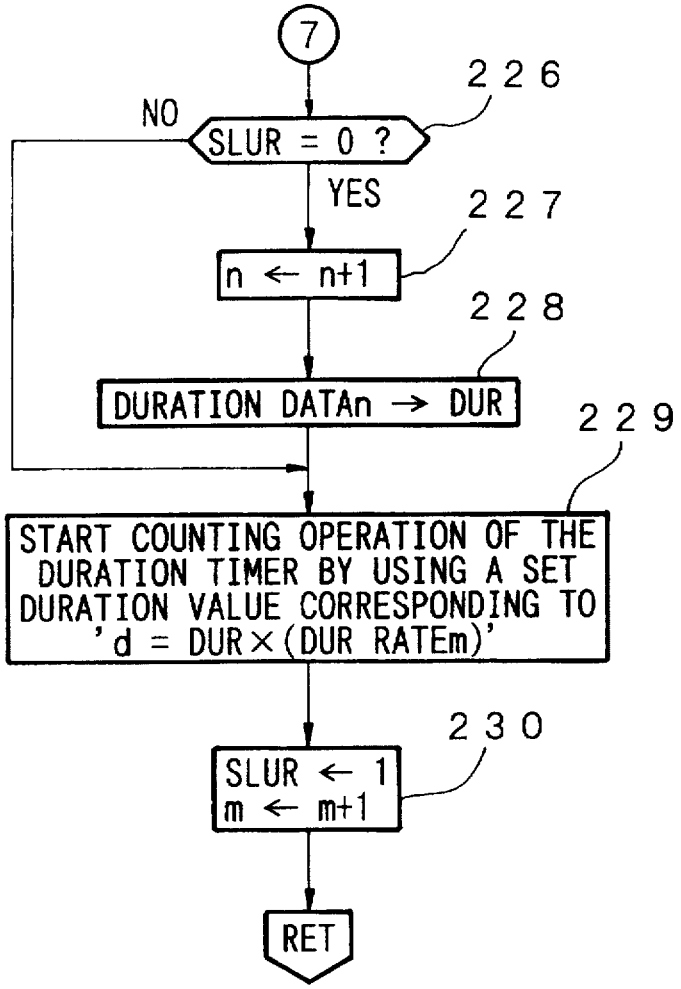
Figure 10C:
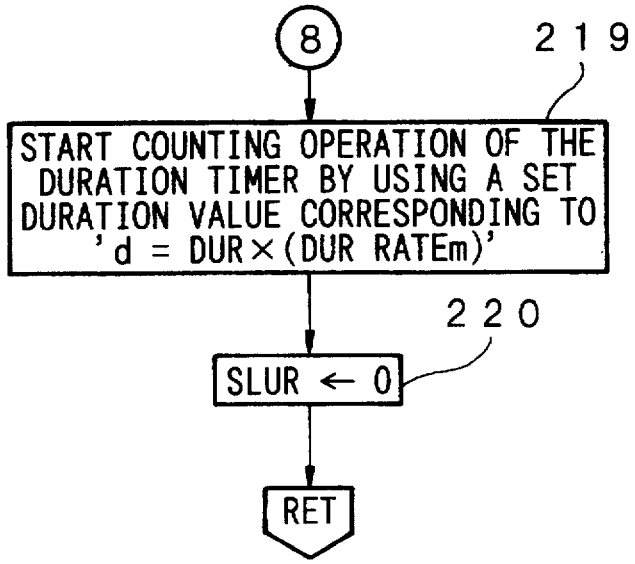

After completion of the step 225, the apparatus executes step 226 in FIG. 10B. In step 226, a decision is made as to whether or not the flag SLUR in the RAM 3 is set at '0'. If the step 226 determines that the flag SLUR is set at '0', in other words, if no syllable remains to be sounded with respect to a same key-on event, the apparatus proceeds to step 227 in which the melody-event pointer n is renewed using an increment of '1'. In step 228, the register DUR of the RAM 3 stores duration data (DURATION) contained in event data EVENTn which are designated by the renewed melody-event pointer. In step 229, a value of the register DUR is multiplied by sounding-sustain-rate data (DUR RATEm) contained in the voice event data VEVENTm, so that result of multiplication is used as a set duration value to start a counting operation of the duration timer.

On the other hand, if result of the decision of the step 226 is 'NO', program control directly goes to step 229 without executing the steps 227 and 228.

After execution of the step 229, the apparatus proceeds to step 230 in which the flag SLUR is set at '1' whilst the voice-event pointer m is renewed using an increment of '1'. Then, execution of the performance process is ended.

Figure 8A:
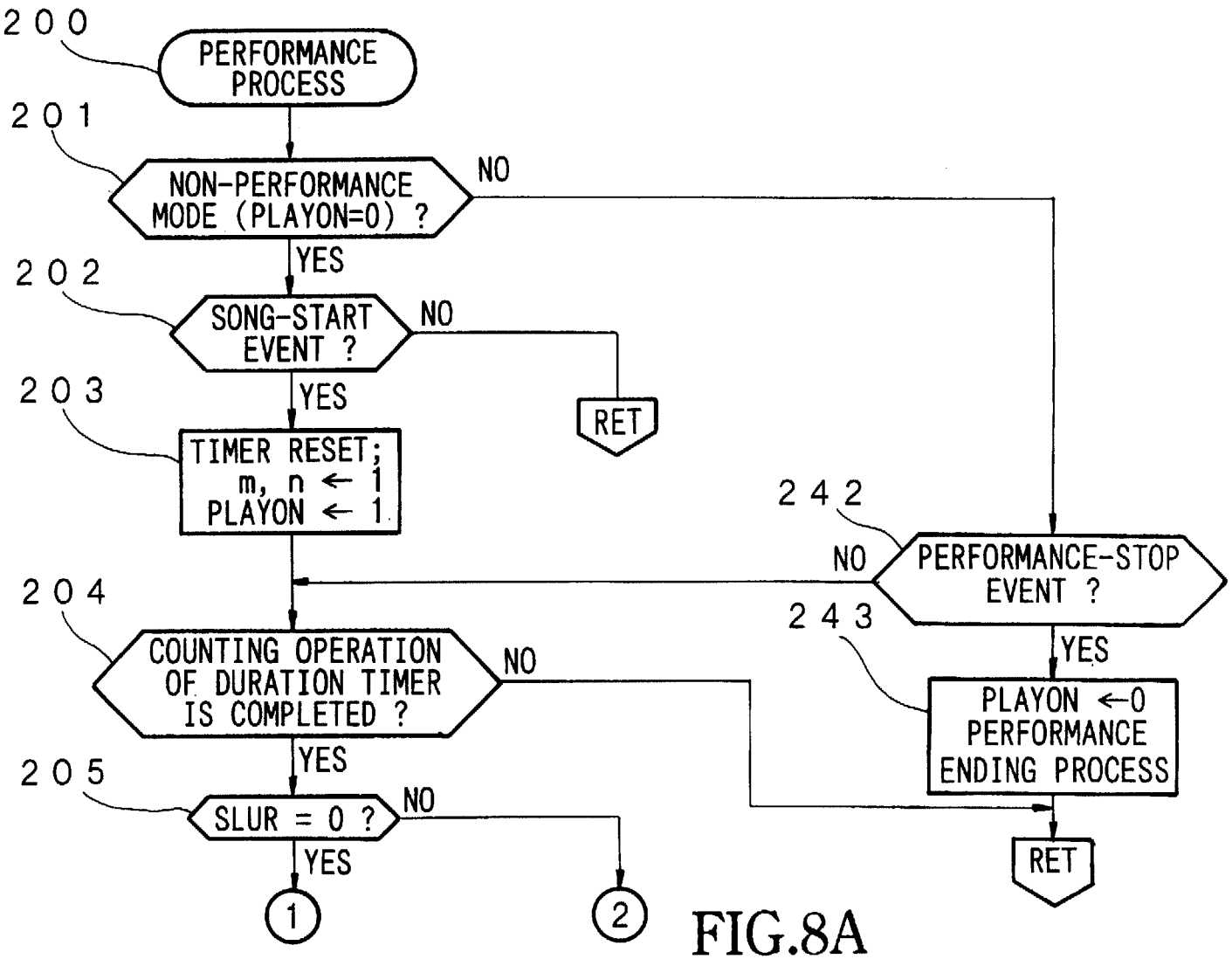
FIGS. 8A and 8B are flowcharts showing parts of a performance process.
Figure 8B:
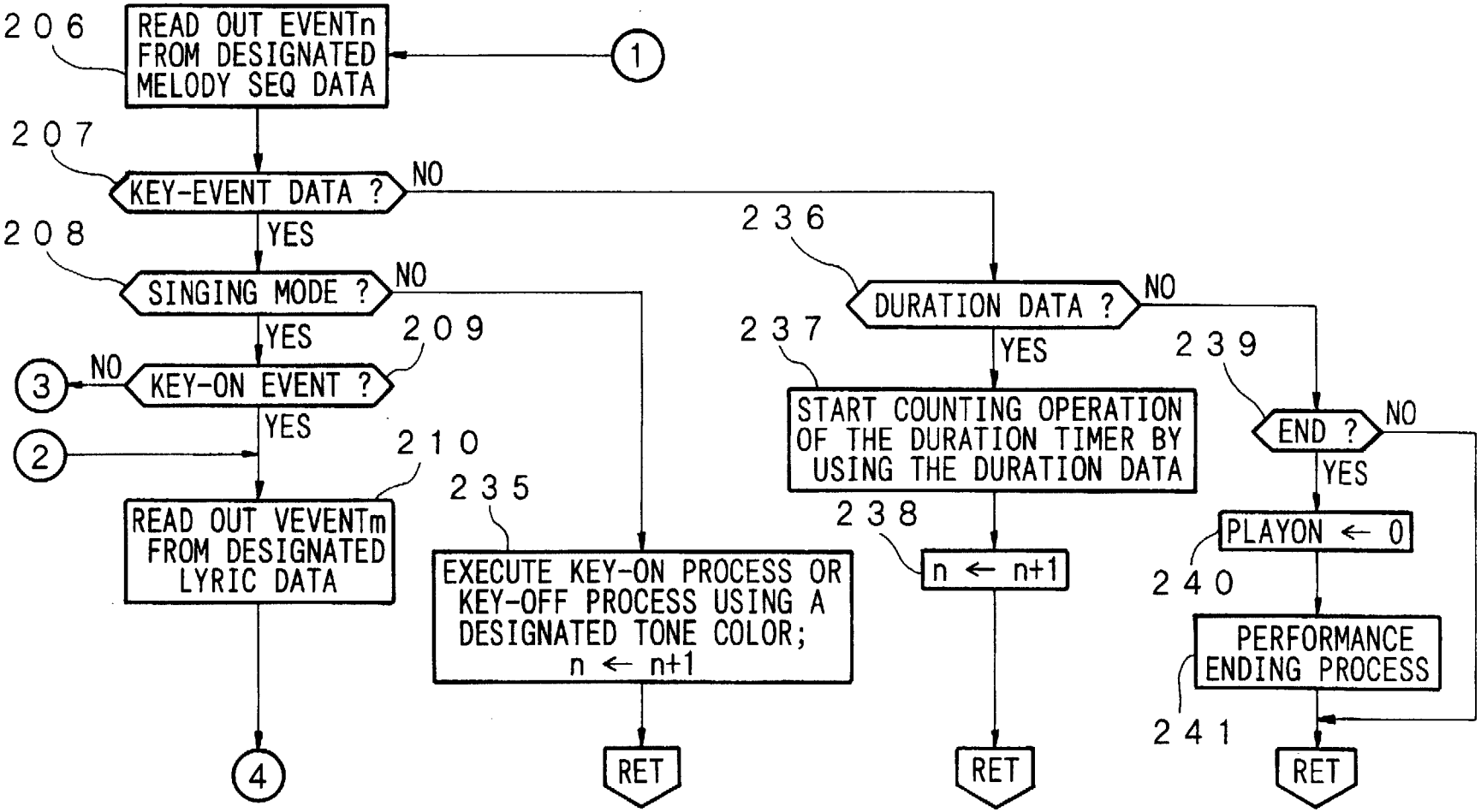
Figure 9A:
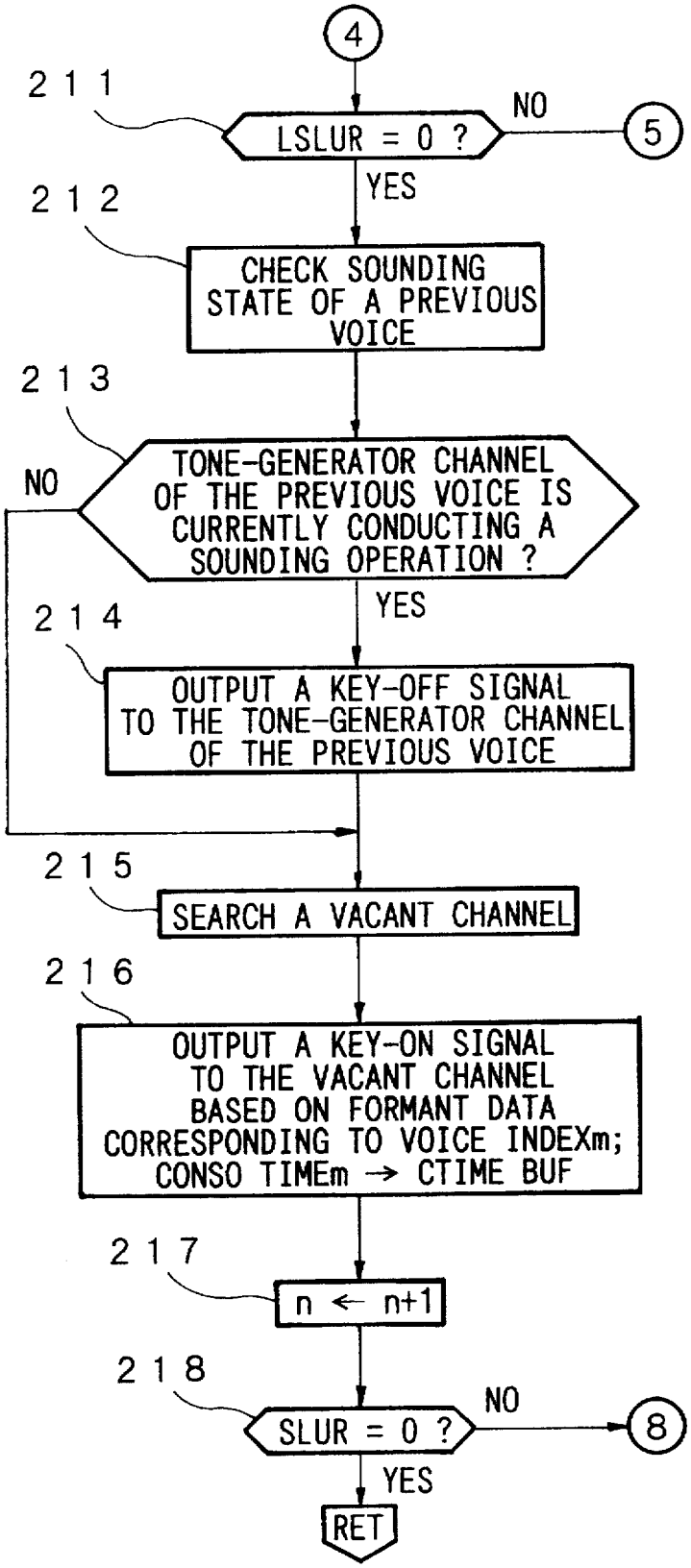
FIGS. 9A and 9B are flowcharts showing another parts of the performance process.
Figure 9B:
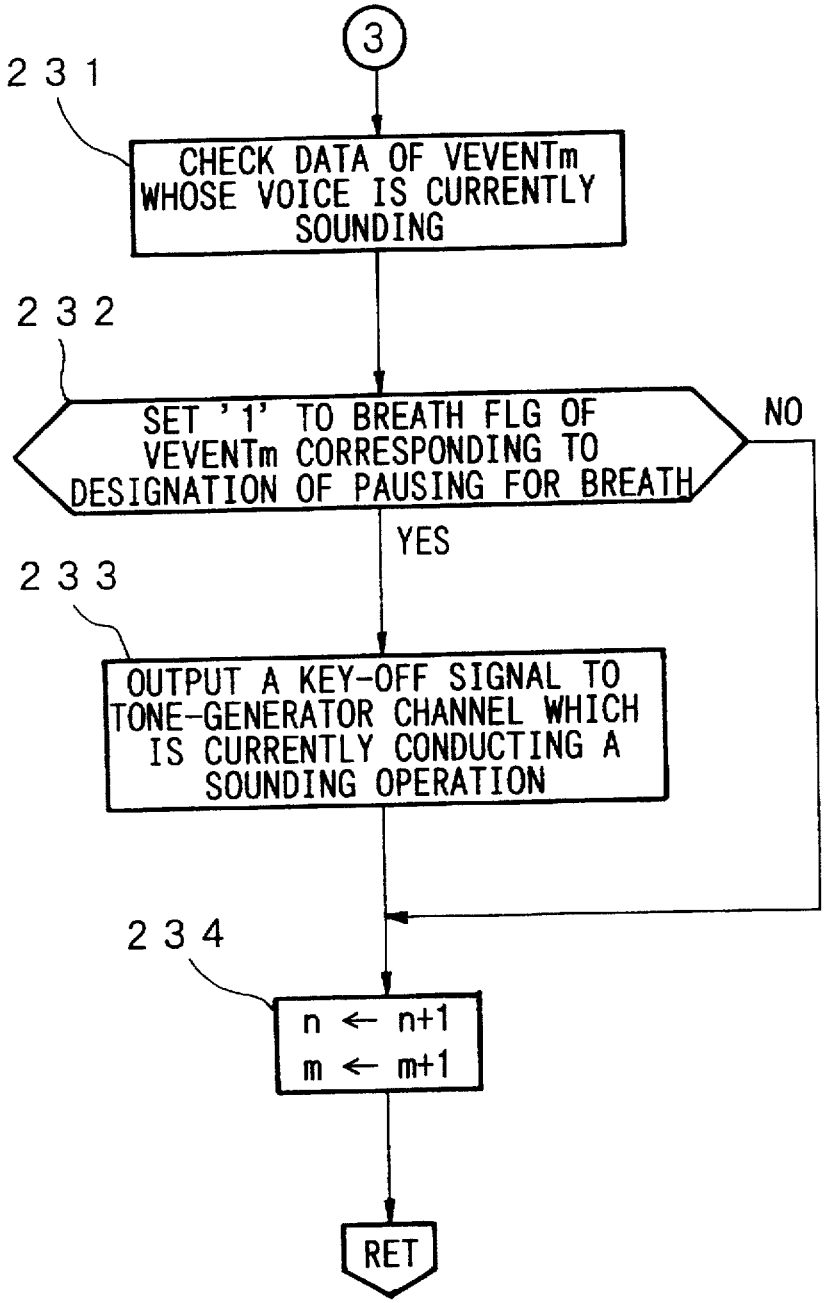

By the way, if result of the decision made by the aforementioned step 209 in FIG. 8B turns to 'NO', in other words, if the key-event data do not correspond to a key-on event, that is, if the key-event data correspond to a key-off event, program control goes to step 231 in FIG. 9B. In step 231, the apparatus checks data contained in the voice event data VEVENTm whose voice is currently sounding. In step 232, a decision is made as to whether or not '1' is set for a breath designating flag (BREATH FLG) provided in the voice event data VEVENTm. If result of the decision is 'YES', the apparatus proceeds to step 233 so as to output a key-off signal to a tone-generator channel which is currently conducting a sounding operation. Then, the apparatus proceeds to step 234. On the other hand, if result of the decision of the step 232 is 'NO', program control directly goes to step 234. In step 234, the melody-event pointer n is renewed using an increment of '1' whilst the voice-event pointer m is renewed using an increment of '1'. Then, execution of the performance process is ended. Thus, in case of the key-off event, sounding of a syllable which is currently sounded is stopped if pausing for breath is designated. If pausing for breath is not designated, the key-off event is neglected so that sounding of the syllable is not stopped.

Meanwhile, if result of the decision of the aforementioned step 208 is 'NO', in other words, if the apparatus is not set in the singing mode but is set in the performance mode (e.g., melody performance mode), the apparatus proceeds to step 235 in FIG. 8B. In step 235, a key-on process or a key-off process is executed using a certain tone color whilst the melody-event pointer n is renewed using an increment of '1'. Then, execution of the performance process is ended. In short, a reading operation for the lyric sequence data (LYRIC DATA) is not performed using the voice-event pointer m.

If result of the decision made by the aforementioned step 207 is 'NO', the apparatus proceeds to step 236 in which a decision is made as to whether or not the read event data EVENTn correspond to duration data (DURATION). If result of the decision is 'YES', the apparatus proceeds to step 237 in which a value of the duration data is used as a set duration value to start a counting operation of the duration timer. In next step 238, the melody-event pointer n is renewed using an increment of '1'. Then, execution of the performance process is ended.

On the other hand, if result of the decision of the step. 236 is 'NO', the apparatus proceeds to step 239 in which a decision is made as to whether or not the event data EVENTn correspond to an end code (END). If result of the decision is 'NO', execution of the performance process is ended. In contrast, if result of the decision is 'YES', the flag PLAYON is reset to '0' in the RAM 3. In next step 241, the apparatus executes a performance ending process. Then, execution of the performance process is ended.

Figure 11:
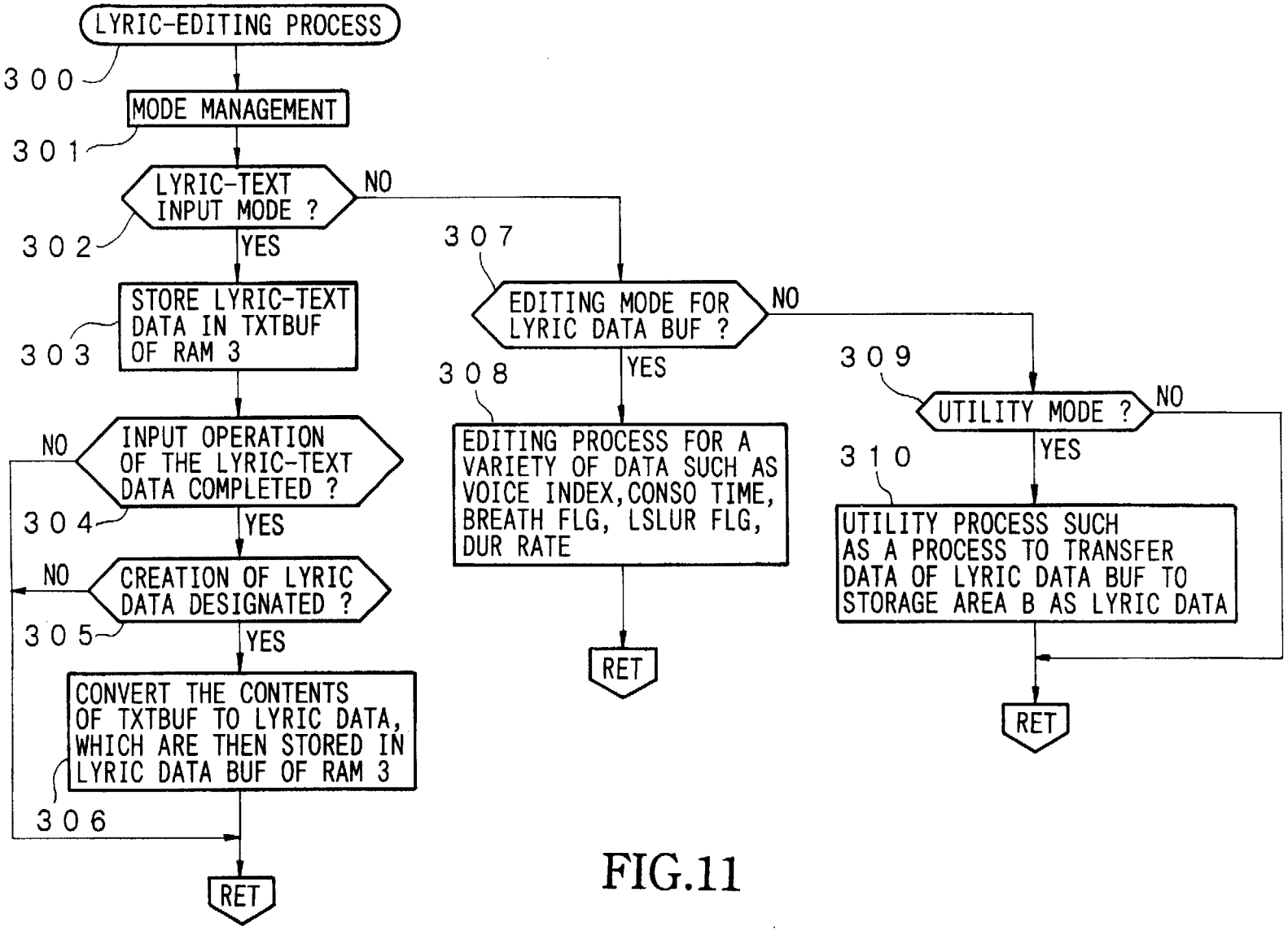
FIG. 11 is a flowchart showing a lyric-editing process.

Next, details of the lyric-editing process (see step 300 in FIG. 7) will be described with reference to FIG. 11.

As described before, if the main program of FIG. 7 determines that result of the decision of the step 104 is 'NO', the apparatus recognizes that the lyric-editing mode is selected. Hence, the apparatus performs the lyric-editing process of step 300, details of which is shown by FIG. 11. In first step 301, mode management is performed with respect to the lyric-editing process. In step 302, a decision is made as to whether or not a lyric-text input mode is designated. If result of the decision is 'NO', the apparatus proceeds to step 307 so as to make a decision as to whether or not an editing mode for the lyric-sequence-data buffer (LYRIC DATA BUF) provided in the RAM 3 is designated. If result of the decision is 'NO', the apparatus proceeds to step 309 so as to make a decision as to whether or not a utility mode is designated. If result of the decision is 'NO', execution of the lyric-editing process is terminated.

Meanwhile, if result of the decision of the step 302 is 'YES', in other words, if the lyric-text input mode is designated, the apparatus proceeds to step 303 in which lyric-text data, which are inputted by manipulating the text-data input section 6, are stored in the lyric-text buffer TXTBUF of the RAM 3. In next step 304, a decision is made as to whether or not an input operation to input the lyric-text data is completed. If the input operation has not been completed, execution of the lyric-editing process is terminated. On the other hand, if result of the decision of the step 304 is 'YES', the apparatus proceeds to step 305 in which the apparatus inquires of a human operator about a question as to whether or not to create lyric sequence data (LYRIC DATA). So, the step 305 makes a decision as to whether or not creation of the lyric sequence data is designated. If result of the decision is 'NO', execution of the lyric-editing process is terminated.

On the other hand, if result of the decision of the step 305 is 'YES', in other words, if the human operator designates creation of the lyric sequence data, the apparatus proceeds to step 306. Herein, the apparatus converts contents of the lyric-text buffer TXTBUF to lyric sequence data by referring to a phoneme dictionary, so that the lyric sequence data are stored in the lyric-sequence-data buffer (LYRIC DATA BUF) of the RAM 3. Then, execution of the lyric-editing process is ended.

If result of the decision of the step 307 is 'YES', in other words, if the editing mode for the lyric-sequence-data buffer (LYRIC DATA BUF) is designated, the apparatus proceeds to step 308. Herein, the apparatus performs an editing process on a variety of data, contained in the voice event data VEVENT designated by the user, i.e., the aforementioned phoneme designating data (VOICE INDEX), consonant-sounding-time data (CONSO TIME), breath designating flag (BREATH FLG), continuous-sounding designating flag (LSLUR FLG) and sounding-sustain-rate data (DUR RATE). Thus, the human operator is capable of editing the lyric sequence data (LYRIC DATA) on demand. Hence, it is possible to perform song control with a high degree of freedom.

In the editing process of step 308, if the continuous-sounding designating flag (LSLUR FLG) is set at '1', for example, two voice events (i.e., a current voice event and its next voice event) should be subjected to a sounding operation based on a same key event (e.g., a same note). That is, if a syllable 'sa' is followed by its next syllable 'i', those two syllables 'sa-i' can be sounded in response to a same key event. In that case, the human operator sets a continuous-sounding designating flag (LSLUR FLG) at '1' with respect to a first voice event (VEVENT) corresponding to the syllable 'sa'; and the human operator inputs a certain value to a sounding-sustain-rate data (DUR RATE). Thus, the editing process of step 308 is activated to automatically set sounding-sustain-rate data (DUR RATE), corresponding to a second voice event for the syllable 'i' which follows the first voice event for the syllable 'sa', at a value which is calculated by subtracting the value of the sounding-sustain-rate data of the first voice event from '1'. In short, the editing process automatically determines that a sum of the sounding-sustain-rate data of the two voice events which are connected together by the continuous-sounding designating flag (LSLUR FLG) become equal to '1'.

By the way, if result of the decision of the step 309 is 'YES', in other words, if the utility mode is designated, the apparatus proceeds to step 310 in which some utility process is performed. For example, data stored in the lyric-sequence-data buffer (LYRIC DATA BUF) of the RAM 3 are transferred to the lyric-sequence-data storage area B of the data memory 4.

Figure 12:
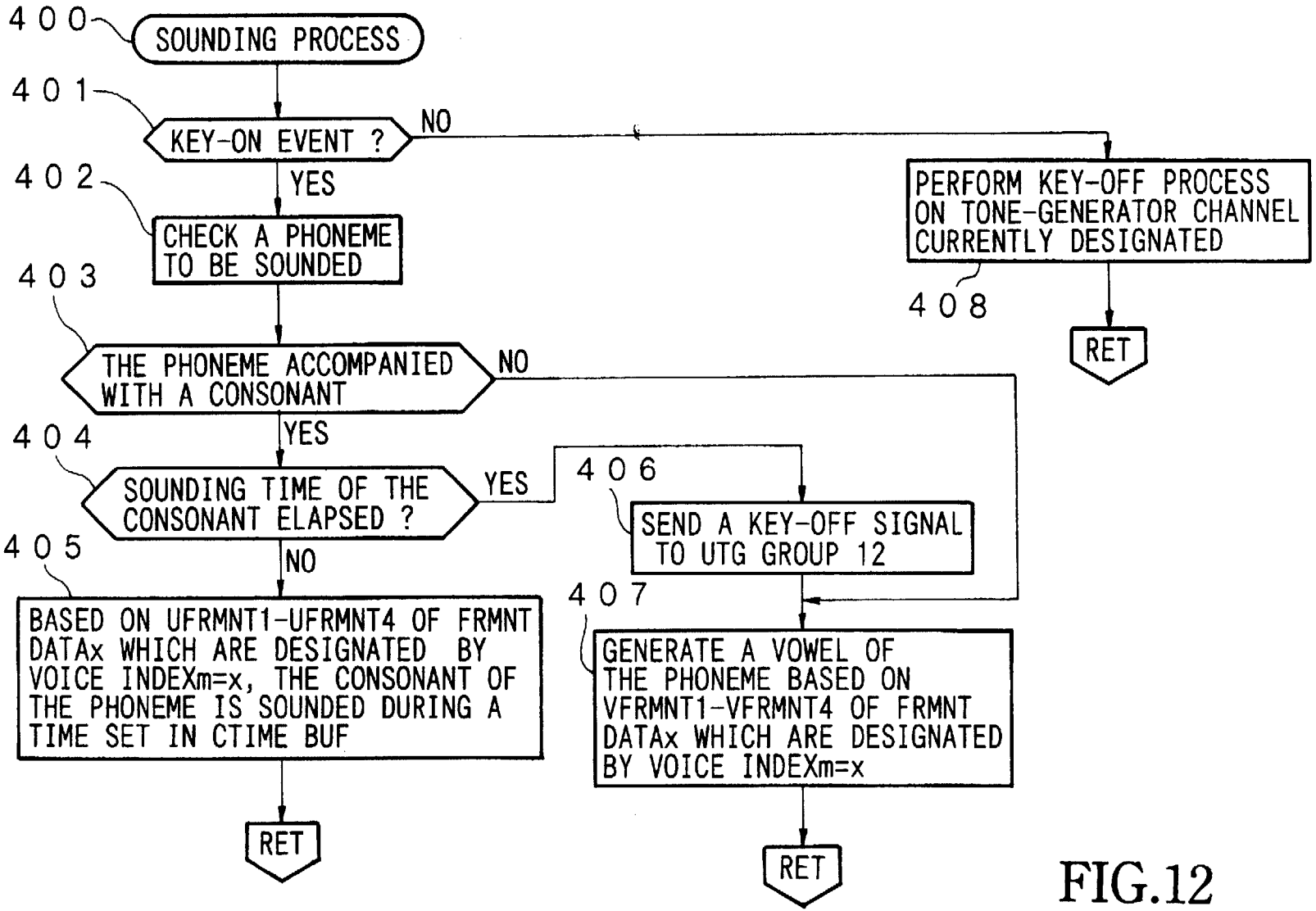
FIG. 12 is a flowchart showing a sounding process.

Next, details of the sounding process of step 400 (see FIG. 7) will be described with reference to FIG. 12.

As described before with respect to the main program of FIG. 7, the sounding process of step 400 is executed after the performance process of step 200 or the lyric-editing process of step 300 is completed. In the sounding process of step 400, parameters are supplied to each of the tone generators (i.e., each of VTG1–VTG4 and UTG1–UTG4) of the tone-generator channel currently designated by each frame time, so that the apparatus will generate phonemes which vary with respect to time. When the apparatus enters into the sounding process of step 400, program control goes to step 401 shown in FIG. 12. In step 401, a decision is made as to whether or not a key-on event occurs. If result of the decision is 'NO', it is detected that a key-off event currently stands. Thus, the apparatus proceeds to step 408 in which a key-off process is performed with respect to the tone-generator channel currently designated. Then, execution of the sounding process is terminated.

If result of the decision of the step 401 is 'YES', in other words, if a key-on event currently stands, the apparatus proceeds to step 402 so as to check a phoneme to be sounded. In next step 403, a decision is made as to whether or not the phoneme to be sounded is accompanied with a consonant. If result of the decision is 'NO', it is indicated that the phoneme to be sounded consists of a vowel only. So, the apparatus proceeds to step 407, details of which will be described later. On the other hand, if result of the decision of the step 403 is 'YES', the apparatus proceeds to step 404 in which a decision is made as to whether or not a sounding time of the consonant is elapsed.

If result of the decision of the step 404 is 'YES', the apparatus proceeds to step 405 which performs operations as follows:

With respect to the phoneme whose sounding operation is designated, consonant formant data UFRMNT1 to UFRMNT4, contained in formant data (FRMNT DATAx) which are designated by phoneme designating data (VOICE INDEXm=x), are supplied to the tone generators UTG1 to UTG4 of the UTG group 12 respectively. The sounding operation is performed during a time which is set by the buffer (CTIME BUF) of the RAM 3. Thereafter, execution of the sounding process is ended.

By the way, if result of the decision of the step 404 is 'NO', in other words, if the sounding time of the consonant has not been completely elapsed, the apparatus proceeds to step 406 so as to issue a key-off instruction to the UTG group 12. In next step 407, vowel formant data VFRMNT1 to VFRMNT4, contained in the formant data (FRMNT DATAx) which are designated by the phoneme designating data (VOICE INDEXm=x), are supplied to the tone generators VTG1 to VTG4 of the VTG group 11 respectively, so that a sounding operation is performed with respect to a vowel. Thereafter, execution of the sounding process is ended.

Incidentally, the description of the preferred embodiment described heretofore omits explanation about controlling of a (musical) interval of a voice to be generated. However, the interval can be easily controlled using a keycode contained in the melody sequence data (MELODY SEQ DATA) by controlling pitch frequency of each tone generator.

Figure 13:
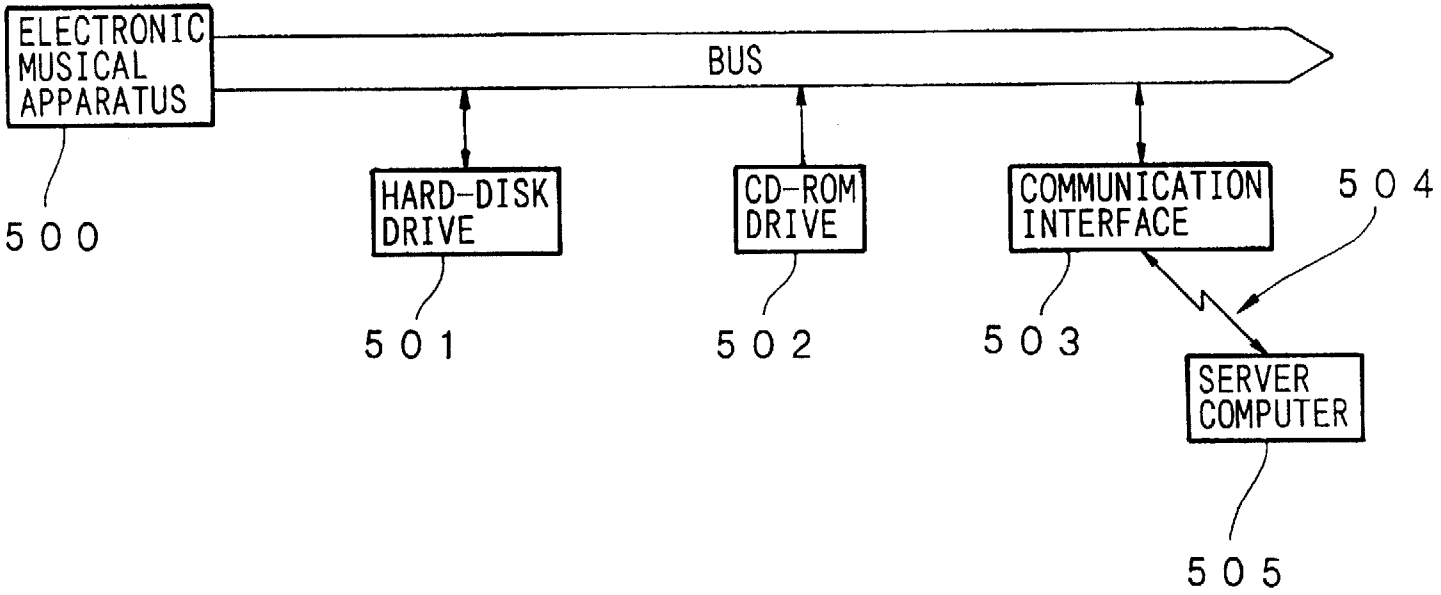
FIG. 13 is a block diagram showing an extended system for the electronic musical apparatus.

The applicability of the electronic musical apparatus of the invention (see FIG. 1) can be extended in a variety of manners. For example, FIG. 13 shows a system in which an electronic musical apparatus 500 is connected to a hard-disk drive 501, a CD-ROM drive 502 and a communication interface 503 through a bus. Herein, the hard-disk drive 501 provides a hard disk which stores operation programs (e.g., programs of the present embodiment) as well as a variety of data such as automatic performance data and chord progression data. If the CPU memory 2 of the electronic musical apparatus 500 does not store the operation programs, the hard disk of the hard-disk drive 501 stores the operation programs, which are then transferred to the RAM 3 on demand so that the CPU 1 can execute the operation programs. If the hard disk of the hard-disk drive 501 stores the operation programs, it is possible to easily add, change or modify the operation programs to cope with a change of a version of a software.

In addition, the operation programs and a variety of data can be recorded in a CD-ROM, so that they are read out from the CD-ROM by the CD-ROM drive 502 and are stored in the hard disk of the hard-disk drive 501. Other than the CD-ROM drive 502, it is possible to employ any kinds of external storage devices such as a floppy-disk drive and a magneto-optic drive (i.e., MO drive).

The communication interface 503 is connected to a communication network 504 such as a local area network (i.e., LAN), a computer network such as 'internet' or telephone lines. The communication network 504 also connects with a server computer 505. So, programs and data can be downloaded to the electronic musical apparatus 500 from the server computer 505. Herein, the system issues commands to request 'download' of the programs and data from the server computer 505; thereafter, the programs and data are transferred to the system and are stored in the hard disk of the hard-disk drive 501.

Moreover, the present invention can be realized by a 'general' personal computer which installs the operation programs and a variety of data which accomplish functions of the invention such as the function of formant sound synthesis. In such a case, it is possible to provide a user with the operation programs and data pre-stored in a storage medium such as a CD-ROM and floppy disks which can be accessed by the personal computer. If the personal computer is connected to the communication network, it is possible to provide a user with the operation programs and data which are transferred to the personal computer through the communication network.

Lastly, the present embodiment is designed to generate voices corresponding to the Japanese language. However, the present embodiment can be modified to cope with other languages such as the English language. In that case, the data memory 4 stores a plurality of formant data corresponding to syllables of a certain language arbitrarily selected.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. An electronic musical apparatus comprising:

storage means for storing lyric data and melody data;

allocation means, which is occasionally activated based on a relationship between the lyric data and the melody data, for allocating generation of a plurality of syllables demanded by the lyric data to a time between the beginning of a desired single note and the beginning of a next note within notes constructing a melody designated by the melody data;

reading means for reading out the lyric data in accordance with the melody data; and sounding means for sequentially sounding phonemes designated by the lyric data in accordance with the melody designated by the melody data, whereby when the allocation means is activated, the plurality of syllables are sequentially sounded corresponding to the desired single note.

2. An electronic musical apparatus comprising:

storage means for storing lyric data and melody data;

setting means for setting a consonant sounding time for each consonant;

reading means for reading out the lyric data in accordance with the melody data; and sounding means for sequentially sounding phonemes designated by the lyric data in accordance with a melody designated by the melody data, wherein if a syllable to be sounded contains a consonant, a sounding time of the syllable is controlled responsive to the consonant sounding time set by the setting means.

3. An electronic musical apparatus comprising:

storage means for storing lyric data and performance data which designates notes of a melody;

tone-generator means containing a plurality of tone-generator channels each of which includes a vowel generation unit and a consonant generation unit, wherein the vowel generation unit contributes to generation of vowels and the consonant generation unit contributes to generation of consonants, so that the tone-generator means generates sounds and/or voices based on formant sound synthesis; and control means for controlling the tone-generator means such that voices corresponding to words of a lyric designated by the lyric data are sequentially generated in accordance with a melody designated by the performance data.

4. An electronic musical apparatus according to claim 3 further comprising detecting means for detecting an event in which generation of multiple syllables, designated by the lyric data, is allocated to a desired single note within notes corresponding to the melody designated by the performance data, wherein the control means controls the tone-generator means such that the multiple syllables are sequentially generated corresponding to the sounding of the desired single note.

5. An electronic musical apparatus according to claim 3 further comprising setting means for setting a consonant sounding time for each consonant, wherein the consonant generation unit is controlled responsive to the consonant sounding time.

6. An electronic musical apparatus according to claim 3 further comprising:

setting means for setting a consonant sounding time for each consonant; and detecting means for detecting a consonant event in which a syllable to be generated is accompanied with a consonant, wherein the consonant generation unit is activated to generate the consonant with respect to the consonant sounding time.

7. An electronic musical apparatus according to claim 3 further comprising detecting means for detecting a breath event, based on the lyric data, in which pausing for breath is designated, wherein the control means controls the tone-generator means such that a specific duration corresponding to the breath event is provided between generation of a syllable and generation of its next syllable.

8. An electronic musical apparatus according to claim 3 further comprising detecting means for detecting a lyric-text input mode, wherein words of a lyric are inputted to form lyric data by a human operator who manipulates a computer keyboard.

9. An electronic musical apparatus according to claim 3 further comprising detecting means for detecting an editing mode, wherein the lyric data are edited by a human operator who manipulates a computer keyboard.

10. A storage device storing lyric data and performance data which are transferred to an electronic musical apparatus which employs a tone-generator section consisting of a vowel generation unit and a consonant generation unit, the storage device further storing programs which cause the electronic musical apparatus to execute a lyric performance operation comprising:

sequentially transferring the lyric data to the tone-generator section in synchronization with the performance data; and activating the tone-generator section based on the lyric data so as to sequentially generate voices corresponding to words of a lyric designated by the lyric data in accordance with a melody designated by the performance data, whereby a song is automatically sung by the electronic musical apparatus based on the lyric data and the performance data.

11. A storage device according to claim 10, wherein the lyric performance operation further comprises the steps of:

detecting an event in which generation of multiple syllables is allocated to a desired single note within notes corresponding to the melody designated by the performance data; and controlling the tone-generator section in the event such that the multiple syllables are sequentially generated during a time corresponding to the desired single note.

12. A storage device according to claim 10 wherein the lyric performance operation further comprises the steps of:

setting a consonant sounding time for each consonant;

detecting an event in which a syllable consists of a consonant and a vowel;

controlling the consonant generation unit to generate the consonant during the consonant sounding time; and controlling the vowel generation unit to generate the vowel to follow the consonant.

13. An electronic musical apparatus comprising:

storage means for storing lyric data and melody data;

tone-generator means containing a plurality of tone-generator channels for generating sounds and/or voices based on formant sound synthesis;

control means for controlling the tone-generator means such that voices corresponding to words of a lyric designated by the lyric data are sequentially generated in accordance with a melody designated by the performance data; and detecting means for detecting a breath event, based upon the lyric data, in which pausing for a breath is designated, wherein the control means controls the tone-generator means such that a specific duration corresponding to the breath event is provided between generation of a syllable and generation of the next syllable.

14. An electronic musical apparatus according to claim 13 wherein the breath event is generated in response to a read-out of breath data which is contained in the lyric data.

* * * * *